US009662275B2

(12) United States Patent
Lee

(10) Patent No.: US 9,662,275 B2
(45) Date of Patent: May 30, 2017

(54) ORAL DEVICES

(71) Applicant: Sue S. Lee, Framingham, MA (US)

(72) Inventor: Sue S. Lee, Framingham, MA (US)

(73) Assignee: Sue S. Lee, Framingham, MA (US)

( * ) Notice: Subject to any disclaimer, the term of this patent is extended or adjusted under 35 U.S.C. 154(b) by 147 days.

(21) Appl. No.: 14/790,672

(22) Filed: Jul. 2, 2015

(65) Prior Publication Data

US 2017/0000694 A1 Jan. 5, 2017

(51) Int. Cl.
*A61J 17/00* (2006.01)
*A61J 11/00* (2006.01)
*A61J 17/02* (2006.01)

(52) U.S. Cl.
CPC ..... *A61J 11/007* (2013.01); *A61J 17/001* (2015.05); *A61J 17/02* (2013.01)

(58) Field of Classification Search
CPC ..... A61J 17/00; A61J 17/001; A61J 17/002; A61J 17/003; A61J 17/005; A61J 17/006; A61J 17/007; A61J 17/008; A61J 17/02; A61J 11/00; A61J 11/0035; A61J 11/0045; A61J 11/005; A61J 11/0055; A61J 11/006; A61J 11/007
See application file for complete search history.

(56) References Cited

U.S. PATENT DOCUMENTS 4,834,099 A * 5/1989 Schrooten ..... A61J 11/004 215/11.1
2002/0026218 A1* 2/2002 Roust ..... A61J 17/001 606/236
2004/0059382 A1* 3/2004 Bergersen ..... A61J 17/02 606/234
2004/0178085 A1* 9/2004 Rohrig ..... A45C 11/24 206/205
2008/0210655 A1* 9/2008 Rees ..... A61J 11/006 215/11.5
2009/0039046 A1* 2/2009 Marr ..... A61J 11/0015 215/11.4
2009/0198275 A1* 8/2009 Godown ..... A61J 17/005 606/236
2010/0030264 A1* 2/2010 Roehrig ..... A61J 17/001 606/234

(Continued)

FOREIGN PATENT DOCUMENTS

JP 2008-504095 A 2/2008
JP 2014-166267 A 9/2014

*Primary Examiner* — Jonathan Miles
(74) *Attorney, Agent, or Firm* — Mintz Levin Cohn Ferris Glovsky and Popeo, P.C.; Kongsik Kim; Derek Constantine

(57) ABSTRACT

Oral devices such as a pacifier, bottle cap, teething tools and toys, and methods for using the same are provided. An oral device includes a bulb portion configured to be disposed inside a mouth of a user and a wider neck portion coupled distally to the bulb portion and configured to be held by user's lips. The neck portion is configured such that, when it is sucked on by the user, the neck portion moves in the lateral direction transverse to a longitudinal axis of the oral device from a first, unexpanded configuration to a second, expanded configuration such that a lateral contact area of the neck portion with the user's lips increases. The oral device can include one or more expansion accommodation features that facilitate expansion and retraction of the neck portion.

21 Claims, 8 Drawing Sheets

(56) References Cited

U.S. PATENT DOCUMENTS

| | | | | |
|---|---|---|---|---|
| 2010/0140204 | A1* | 6/2010 | Vischer | A61J 11/00 215/11.1 |
| 2012/0209326 | A1* | 8/2012 | Lutes | A61J 17/005 606/234 |
| 2014/0296915 | A1* | 10/2014 | Finney | A61J 17/00 606/236 |
| 2015/0051646 | A1* | 2/2015 | Chan | A61J 17/001 606/236 |
| 2015/0164748 | A1* | 6/2015 | Brown | A61J 11/0015 215/11.5 |
| 2015/0290087 | A1* | 10/2015 | Kirkland | A61J 11/02 215/11.5 |

* cited by examiner

ORAL DEVICES

TECHNICAL FIELD

The present disclosure relates to oral devices, such as, for example, a pacifier, nipple, teething tool, and bottle cap, arch shaper, or former and a method of using these devices for prevention and treatment of the malocclusion and deformation of oral region and its peripheral structures, as well as prevention and treatment of oral dysfunctions and dysfunctional oral habits.

BACKGROUND

Oral devices, such as a pacifier and/or an artificial nipple on a bottle, are commonly used for pacifying or feeding infants or toddlers. To ensure a proper development of child's oral structures, an appropriate oral device needs to be used, which is particularly important during the infant stage. Even after a child stops using an oral device, the device is often replaced by the child's finger, thumb, lip and/or tongue, and the child can thus develop dysfunctional oral habits. Such oral habits induce abnormal constrictive sucking forces. The adverse effects of constrictive sucking forces on the configuration of dental arch, such as development of malocclusion, have been well established. See Douglass, C. (ed). Oral Care Report 15(2): 4 (2005); Ogaard, B., et al., "The effect of sucking habits, cohort, sex, intercanine arch widths, and breast or bottle feeding on posterior crossbite in Norwegian and Swedish 3-year-old children," *Am J Orthod Dentofacial Orthop.* 106: 161-66 (1994); Warren, J. J., Bishara, S. E., "Duration of nutritive and nonnutritive sucking behaviors and their effects on the dental arches in the primary dentition," *Am J Orthod Dentofacial Orthop.* 121: 347-56 (2002); and Warren, J. J., et al., "Effects of oral habits' duration on dental characteristics in the primary dentition," JADA 132: 1685-93 (2001).

Feeding is a multifunctional process including sucking, chewing, and swallowing, which also modulates the opening of the middle ear tube. Especially for infants, feeding involves multilayered neuromuscular coordination among the functions of sucking, swallowing, and breathing due to the fact that infants are fed in supine position.

In functional aspect, it has been established that artificial nipples alter the mechanism of the oral physiology and that breastfed babies have therefore higher oxygen saturation than bottle-fed babies. Studies showed that bottle-feeding induces a higher rate of swallowing and frequent interruptions of breathing, while breast-feeding allows spontaneous sucking and breathing without disruption from frequent swallowing. During the active infant-child growth period, the neuromuscular coordination of sucking, swallowing, and breathing not only inflicts the development of the dental arches but is also involved in blood oxygenation during feeding.

Multiple types of oral devices have been developed. However, existing oral devices can exacerbate the activation of the oral-facial muscles exerting excessive constriction due to inward and forward forces imparted by a child upon an oral device during sucking.

Accordingly, there is a need for improved oral devices that facilitate sucking force for proper development of oral structures.

SUMMARY

Methods and devices are provided for using an oral device, non-limiting examples of which include a pacifier or a bottle cap for preventing and treating malocclusion and deformation of oral structures. In general, an oral device is provided that can redirect and thus decrease the abnormal constrictive force applied to a user's dental arches and palate when the device is in use (e.g., the device is sucked), thus preventing deformation of the user's dental arches and palate and abnormal eruption of teeth.

In one aspect, an oral device is provided including a bulb portion configured to be disposed inside a user's mouth, a neck portion coupled distally to the bulb portion and configured to be held by user's upper and lower lips and sucked on, and a base portion coupled distally to the neck portion and configured to be connected to a handle. When the neck portion is sucked on by the user, the neck portion moves in the lateral direction transverse to a longitudinal axis of the oral device from a first, unexpanded configuration to a second, expanded configuration so that the lateral angle of the neck portion pushes the labial commissure of user's mouth posteriorly, increasing the width of lips laterally. Thus, the lateral contact area of the neck portion with user's lip increases.

In one aspect, an oral device is provided including a bulb portion configured to be disposed inside a mouth of a user and a neck portion coupled distally to the bulb portion and configured to be held by user's lips. The oral device is configured such that, when the neck portion is sucked by the user, the neck portion is configured to move in the lateral direction transverse to a longitudinal axis of the oral device from a first, unexpanded configuration to a second, expanded configuration such that a lateral contact area of the neck portion with user's lips increases.

The oral device can vary in a number of ways. For example, the neck portion can include an expansion accommodation portion adapted to accommodate the lateral expansion of the neck portion.

The expansion accommodation portion can vary in a number of ways. For example, the lateral expansion accommodation portion can be thinner than at least one of an other portion of the neck and the bulb portion. In other embodiments, the lateral expansion accommodation portion can be made of a material which is different than at least one of an other portion of the neck and the bulb portion. For example, the lateral expansion accommodation portion can be made of a material which is softer than at least one of the other portion of the neck and the bulb portion. In yet other embodiments, the lateral expansion accommodation portion of the neck can include a portion of the neck portion that has at least one dimension that is greater than at least one dimension of the bulb.

In some embodiments, at least one of the bulb portion and the neck portion can have a square, rectangular, circular, oval, triangular, trapezoidal, heart-like shape and/or any shape in the first configuration. At least one of the bulb portion and the neck portion can have any morphologic combination into fractal configurations and any half and/or inverted form.

A width of the neck portion can be greater than a width of the bulb portion along entire lengths of the bulb and neck portions.

The neck portion can further include at least one expanded portion such that, when the oral device is in the first configuration, the expanded portion causes the neck portion to be disposed asymmetrically with respect to a longitudinal axis of the oral device.

The oral device can further include a base portion coupled to a distal is end of the neck portion, wherein the neck portion is directly coupled to the base portion. The distal end of the base portion can be configured to couple with a suitable device.

In some aspects, a method of preventing or treating deformation of an arch form and malocclusion of teeth of a user is provided. The method includes administering an oral device to the user, the oral device including a bulb portion and a neck portion coupled distally to the bulb portion, so that the bulb portion is disposed inside a mouth of the user and the neck portion is held by user's lips. When the neck portion is sucked by the user, the neck portion moves in a lateral direction transverse to a longitudinal axis of the oral device from a first, unexpanded configuration to a second, expanded configuration such that a lateral contact area of the neck portion with the user's lips increases.

The method can vary in a number of ways. For example, the neck portion can move to the expanded configuration such that a width of the neck portion increases. The width of the neck portion can be greater than a width of the bulb portion along entire lengths of the bulb and neck portions. The neck portion can include an expansion accommodation portion adapted to accommodate the lateral expansion of the neck portion.

BRIEF DESCRIPTION OF THE DRAWINGS

The embodiments described above will be more fully understood from the following detailed description taken in conjunction with the accompanying drawings. The drawings are not intended to be drawn to scale. For purposes of clarity, not every component may be labeled in every drawing. In the drawings.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

The present disclosure relates to oral devices, such as a pacifier, nipple, teething tool, bottle cap, arch shaper and former, integrating the functional aspect of feeding. The present disclosure particularly relates to a pacifier or nipple that facilitates proper sucking forces, thus restoring and maintaining the natural oral and peripheral configurations for normal oral physiology, as a child sucks on the oral device in accordance with the described embodiments. Also, products including the described oral device, as well as methods of using these products and the oral device are provided for prevention and treatment of the malocclusion and deformation of oral region and its peripheral structures, as well as prevention and treatment of oral dysfunctions and dysfunctional oral habits.

Figure 1:
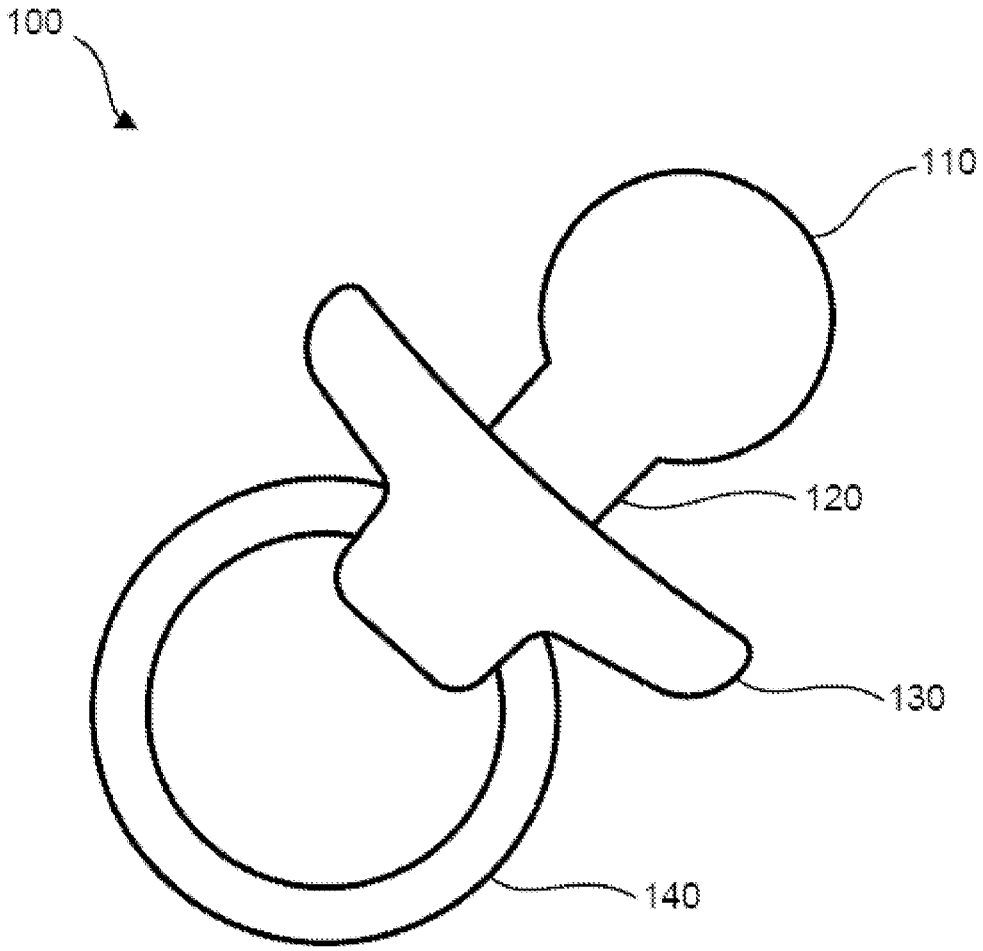
PRIOR ART FIG. 1
FIG. 1 is a schematic side view of a conventional oral device.

Various oral devices have been developed. For example, FIG. 1 illustrates an example of a conventional oral device, such as a pacifier 100. As shown, the pacifier 100 includes a bulb portion 110 configured to be disposed within a user's (e.g., child's) mouth and sucked on by the user, a neck 120 disposed distally of the bulb portion 110 and configured to be held by the user's upper and lower lips, a support portion 130 coupled to the neck 120 and configured to be disposed outside the user's lips, and a handle 140 disposed distally of the support portion 130. It should be appreciated that, as used herein, the term "proximal" refers to a location nearer to a user's body (e.g., user's throat), and the term "distal" refers to a location situated further away from the user's body. Thus, the pacifier 100 is inserted into the user's mouth with the proximal end defined by the nipple being a forward end, while the distal end of the pacifier is disposed outside of the user's mouth when the pacifier is in use. The bulb and neck portions 110, 120, with some modifications, can be used as a bottle cap.

Figure 2A:
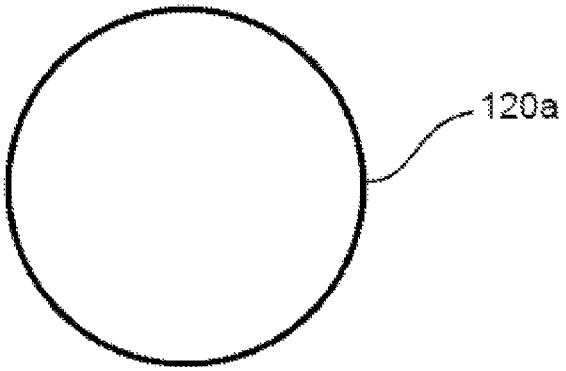
FIG. 2A is a schematic top, cross-sectional view of a neck portion of the oral device of FIG. 1.
Figure 2B:
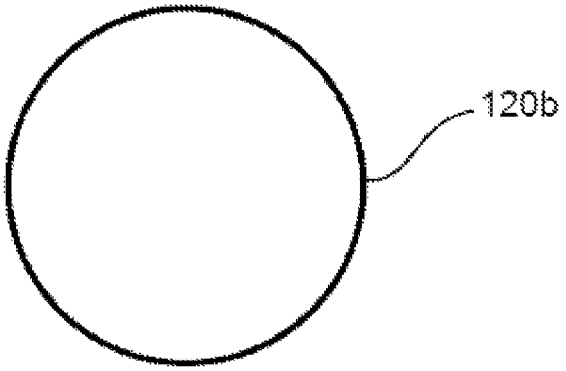
FIG. 2B is another schematic top, cross-sectional view of a neck portion of the oral device of FIG. 1.

In a conventional pacifier or a bottle cap, the bulb portion is generally larger than the neck portion. For example, as shown in FIG. 1, the bulb portion 110 of the pacifier 100 has a larger cross-section than a cross-section of the neck 120 along the entire respective lengths of the bulb portion 110 and neck 120. Furthermore, the shape and size of the cross-section of the neck 120 remains the same regardless of whether or not the pacifier 100 is being used (i.e., whether or not the bulb portion 110 is being sucked on by the user). For example, FIGS. 2A and 2B illustrate that the neck 120 has the top cross-sections 120*a* and 120*b* having same configuration when no sucking is imparted upon the bulb portion 110 (FIG. 2A) and during the user's sucking upon the bulb portion 110 (FIG. 2B). In other words, the neck 120 remains passive during operation of the pacifier 110 and is configured such that its shape and size are maintained the same. Thus, the forward and medial movements of lips performed by a child upon grasping an oral device stay the same during sucking. While a child is sucking on the oral device, such lip postures induce insufficient closure of the oro-pharyngeal isthmus. As a result, biological neuromuscular coordination of breathing during feeding processes using such conventional bottle cap can be interrupted by frequent accidental swallowing.

Additionally, the conventional oral devices can have no features that would facilitate retraction of the oral device when a user stops sucking. As a result, the oral device, such as the pacifier 100 or a similar oral device, remains in the user's mouth and causes lip muscles to continuously contract, thus stimulating the abnormal sucking when even when the device is not in use. Further, such oral devices can pull the right and left labial commissures towards each other. This forces the cheek muscles inward and the anterior tongue muscles forward, generating abnormal forward and inward forces during sucking, which causes constricted arch form and high palate, and can lead to other undesirable effects during growth and development of facial structures.

The aspects described herein provide oral devices configured to expand or inflate as a user sucks on a bulb portion and at least a portion of a neck portion of a device. Such an oral device can restore the normal biologic sequence of neuromuscular activation causing sealing of the oral chamber while a child is sucking on the oral device. In aspects in which the described oral device is used for feeding (e.g., as a bottle cap or other device), the device can allow collecting and preparing food and/or liquid for proper digestion, which can prevent accidental flux of food and air into the respiratory and digestive systems. Furthermore, when the user stops sucking the oral device (e.g., when the user falls asleep), the oral device is configured to retract away from the user's mouth, which prevents the continuation of unintended or "false" sucking.

Accordingly, the methods and devices described herein modulate the feeding function and promote proper development of oral and facial structures. The described techniques can be guided by the Dentometrics™ theory and analysis developed by the applicant. According to Dentometrics™, a dental arch, such as the upper dental arch, is considered as an anatomical component of a human skull system that is conjoined to the adjacent structures. Dentometrics™ reveals that perimeters of dental arches are predetermined by the human skull structures, and that alteration in an arch configuration impacts the development of the conjoined peripheral structures such that the functional space for the oral-nasal-pharyngeal (ONP) cavities can become abnormal. Abnormal ONP relationships disrupt the normal flux and delivery of air and food into the respiratory and digestive systems, which in turn can interrupt the normal physiologic balance between feeding and breathing.

Dentometrics™ postulates and validates that teeth can be pushed and displaced into the malposition and malocclusion by the deformed dental arch configuration. Certain degrees of arch deformation, in turn, can deter the biological dimensions of arch form in relation to the skull structures, resulting in abnormal oral functions. The Dentometrics™ theory discovers the dental arch configuration that belongs to all human, and its analysis formulates statistical inferences to define the normal perimeter for human dental arches. Also, the degree of severity of malocclusion and its effects on the ONP space can be predicted by the Dentometric Analysis™, which can then be used to prevent deformation of oral and facial structures. The deformation of oral structures, in turn, adversely affect the oral functions, such as breathing, speaking, sleeping, and feeding which involves processes of sucking, chewing, swallowing, as well as opening of the middle ear tube. Thus, the malformation of oral cavity needs to be diagnosed early in life, so that it can be prevented and treated. Since the etiology of malocclusions, as well as lower level of oxygenation, are known as a result of using artificial nipples, oral devices as described herein can help to restore and maintain the normal physiology and biological dimensions of dental arches.

Figure 3B:
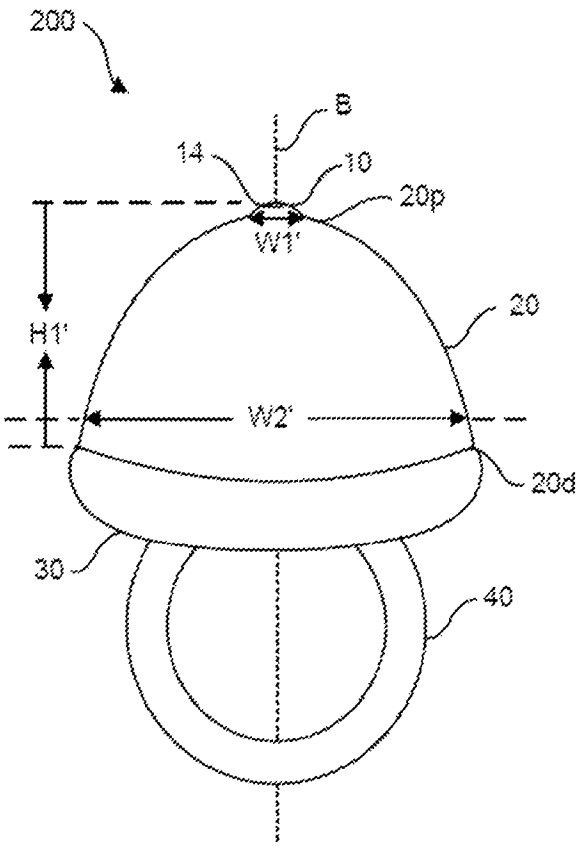
FIG. 3B is a schematic side view of the oral device of FIG. 3A in an expanded configuration.
Figure 3A:
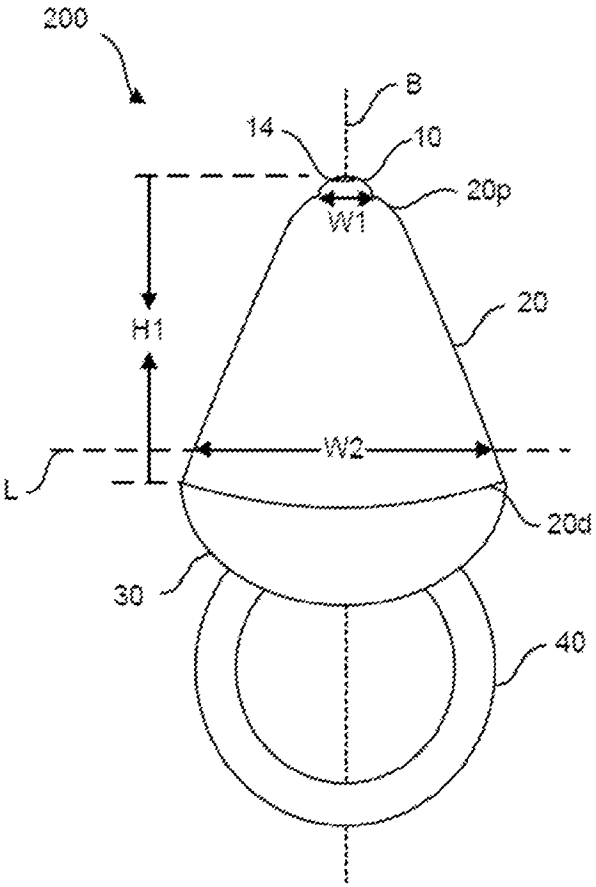
FIG. 3A is a schematic side view of one example of an oral device in an original configuration.

FIGS. 3A and 3B illustrate an example of an oral device 200 that can be administered to a user, such as an infant or a toddler, or any other user who can suck on the device. In the example illustrated, the oral device 200 is in the form of a pacifier. However, a person skilled in the art will understand that the oral device 200 can be a bottle cap, a teething device, a toy, or any other device, or a part of a device that can be administered to a user. Furthermore, the oral device 200 can be a multi-purpose device such that, for example, it can be used as either a pacifier or a bottle cap.

As shown in FIG. 3A illustrating the oral device 200 in an original configuration, the oral device 200 includes a proximal bulb portion 10, a flexible body or neck portion 20 extending distally from the bulb portion 10, an adapter or base portion 30 coupled to a distal end 20*d* of the neck portion 20, and an optional handle portion 40 distally coupled to the base portion 30. As also shown, the bulb, neck, base and handle portions 10, 20, 30, 40 can be aligned axially along a longitudinal axis B of the oral device 200. However, in some embodiments, one or more portions of the device 200, such as the bulb portion 10 and/or the neck portion 20, can be disposed asymmetrically with respect to the longitudinal axis B.

In the illustrated embodiment, the neck portion 20, unlike a neck portion of conventional pacifiers, is flexible and expandable in at least one dimension (e.g., one, two and/or three dimensions). Furthermore, the neck portion 20 is wider than the bulb portion 10 along the entire lengths of the neck portion 20 and the bulb portion 10. The neck portion 20 thus has a greater circumference than a circumference of the bulb portion 10 along any portion of the neck and bulb portions 20, 10. The base portion coupled to the neck portion 30 can also be flexible and can be configured to expand in a suitable way to accommodate the transition of the neck portion between sucking and non-sucking stages. The neck portion 20 is configured to expand laterally and contract so that to mimic expanding and contracting movements of a female breast during breastfeeding of a child.

The bulb portion 10 extends proximally from a proximal end 20*p* of the neck portion 20. The bulb portion 10 has a width W1 that is less than a width W2 of the neck portion 20 as measured across the widest portions of each of the bulb and neck portions 10, 20. As shown in FIG. 3A, the width W2 of the neck portion 20 is measured at a portion thereof along a lip line L where the upper and lower lips of the user engage the oral device 200.

The bulb portion 10 of the oral device 200 can have a variety of configurations. As shown in FIG. 3A, the bulb portion 10 can have a generally semi-circular, semi-ellipsoidal shape, and a width of the bulb portion 10 can increase gradually from a proximal-most end of the bulb portion towards the neck portion 20. In the example illustrated, as shown in FIG. 3A, the bulb portion 10 resembles the shape of a female nipple such that the bulb and neck portions 10, 20 together resemble a shape of a female breast. However, it should be appreciated that the bulb portion 10 can have any suitable shape, including irregular shapes, and, in some embodiments, the width of the entire bulb portion 10 or a portion thereof can decrease towards the neck portion 20. It should also be appreciated that, although the top of the bulb portion 10 shown in FIG. 3A has a generally convex shape, in some embodiments, the top of the bulb portion 10 can be at least partially flattened, concave, and shaped and/or textured in any other manner. Furthermore, in some aspects, the bulb portion can be omitted. Regardless of the specific shape of the bulb portion 10, the bulb and neck portions 10, 20 can be configured to operate during a user's sucking action so as to mimic the natural physiologic movements of a female breast during breastfeeding.

In some aspects, the bulb portion 10 can have additional features. For example, in aspects in which the bulb, neck, and base portions 10, 20, 30 are configured to be disposed over a top of a bottle to be used as a bottle cap, the top of the bulb portion 10 can have an aperture or opening 14 formed therein, as shown in FIGS. 3A and 3B. The opening 14 can be configured to allow fluid to pass from the bottle through the interiors of the neck and bulb portions into the user's mouth. However, it should be appreciated that the opening 14 can be omitted. Furthermore, in some embodiments, the bulb portion may not be present such that the neck portion 20 is configured to expand or inflate and contract or deflate so as to cause an abnormal constrictive sucking to transition to a normal sucking.

The neck portion 20 can also have a variety of configuration. As shown in FIG. 3A, in the example illustrated, the neck portion 20 is generally trapezoidal and a width of the neck portion 20 increases gradually from a proximal end 20*p* to a distal end 20*d* thereof towards the greatest width W2 near the base portion 30. However, it should be appreciated that, in some embodiments, a width of the neck portion 20 does not increase along the entire length thereof such that one or more sections of the neck portion 20 can have a constant width.

The neck portion 20 is configured such that the entirety of the neck portion 20 or one or more of its portions can reversibly expand. Although not shown in FIGS. 3A and 3B, in some aspects, the neck portion 20 can include one or more features that facilitate operation of the neck portion 20 in accordance with the described techniques. Such features can facilitate the neck portion's expansion and contraction as the user is sucking on the oral device 200. Also, the neck portion 20 can have one or more expansion accommodation portions that allow the neck portion 20 to reversibly expand as described in more detail below. Additionally, the neck portion 20 can include features, such as, for example, blind pores (e.g., "dimples") or any textures that facilitate grasping of the neck portion 20 by the user's lips.

Figure 4B:
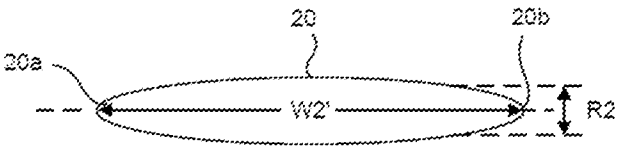
FIG. 4B is a schematic top, cross-sectional view of a neck portion of the oral device of FIG. 3A in an expanded configuration.
Figure 4A:
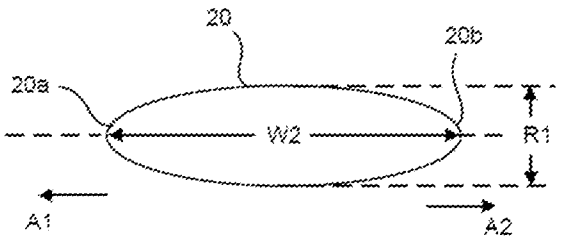
FIG. 4A is a schematic top, cross-sectional view of a neck portion of the oral device of FIG. 3A in an original configuration.

In the example illustrated, the neck portion 20 has a generally ellipsoidal cross-sectional shape, as shown schematically in FIGS. 4A and 4B. It should be appreciated, however, that the neck portion 20 can have any other cross-sectional shape. In the example of FIG. 3A, the bulb and neck portions 10, 20 together have a generally flattened, dome-like shape with the rounded proximal top. It should be appreciated, however, that the bulb and neck portions 10, 20 can have any suitable sizes and configurations such that at least a portion of the neck portion 20 is wider than the bulb portion 10. For example, the bulb 10 and neck portion 20 can be square, rectangular, circular, oval, triangular, trapezoidal, heart-shaped and/or they can have any combination into their fractal configurations, and any half and/or inverted forms. Furthermore, at least a portion of bulb and neck portions 10, 20 can be disposed asymmetrically with respect to the longitudinal axis of the oral device 200 in the original configuration.

As shown in FIG. 3B, the neck portion 20 can be configured to expand and contract (or retract) as the sucking action is applied on it and as the sucking action stops, respectively. As upper and lower lips of the user move parallel towards each other, triggered by the sucking action, the compressional pressure exerted onto the top and bottom of the neck portion 20 forces the opposite corners of the neck portion 20 to disperse laterally, resulting in the expansion of the user's oral commissures posteriorly. Thus, the original width W2 of the neck portion 20, also defined as a distance between opposite corners 20*a*, 20*b* of the neck portion 20, can increase to a larger width W2', as shown in FIGS. 3A, 3B, 4A and 4B. Also, as shown in FIGS. 3A and 3B, an overall height H1 of the bulb and neck portions 10, 20 can decrease to a height H1'.

Inside of the user's mouth, when the user is sucking on the oral device 200, the neck portion 20 is configured to continuously expand laterally towards the palatal surface of the molars and elongate towards throat by the force of suction. When the user sucks on the device 200, the neck portion 20 can be flattened, which can cause the transitional lateral forces to be applied towards the corners of the neck portion 20. Thus, as shown in FIGS. 4A and 4B, an original depth R1 of the neck portion 20, as measured across the same portion at which the width W2 is measured, can decrease to a smaller depth R2. When the user stop sucking on the device, expanded walls of the neck portion 20 are "pulled" towards a mid-portion of the neck such that the neck portion 20 adopts its original configuration shown in FIGS. 3A and 4A.

When the bulb and neck portions 10, 20 are sucked on by the user, the neck portion 20 is expanded in opposite directions A1, A2 from its original configuration (FIG. 4A) to the expanded configuration (FIG. 4B) laterally by the compressional pressure exerted onto the top and bottom, as upper and lower lips approximate parallel towards one another. As the neck portion 20 flattens upon sucking such that its height decreases (as shown in FIG. 3B), the transitional lateral forces are generated and exerted to increase the width from W2 to W2' (FIGS. 4A and 4B). In this way, the user mouth's right and left labial commissures are pushed apart (laterally and posteriorly), thereby increasing the lateral contact area between the oral neck portion and the user's mouth. Thus, as shown in FIG. 4B, in the second, expanded configuration, the neck portion 20 has the reduced depth R1' and an increased width W2' compared to the depth R1 and width W2 in the unexpanded configuration, as shown in FIG. 4A. In the expanded configuration, the neck portion 20 can prevent protrusive movements of lips, and thus can prevent inward movements of the cheek muscles and can deactivate forward movements of anterior tongue muscles. Thus, an oral device described herein (e.g., oral device 200) is configured such that, in use, an inward motion of cheek muscles is transitioned outward, which pulls back the corner of the user's mouth, which, in turn, deactivates the forward motion of tongue. The anterior tongue posture is transitioned posteriorly, engaging the muscles of oropharyngeal isthmus.

Referring back to FIGS. 3A and 3B, the bulb and neck portions 10, 20 can have any suitable sizes. In some embodiments, the bulb portion 10 can have a width that ranges from about 5 mm to about 10 mm. The width W1 of the bulb portion 10 in the original configuration can vary from about 10 mm to about 30 mm, from about 20 mm to about 30 mm, from about 30 mm to about 35 mm, or within other ranges. In the expanded configuration, the width W1' of the bulb portion can vary from about 15 mm to about 35 mm, from about 25 mm to about 35 mm, from about 30 mm to about 35 mm, from about 30 mm to about 40 mm, or within other ranges.

The width W2 of the neck portion 20 in the original configuration can vary from about 20 mm to about 30 mm, from about 30 mm to about 40 mm, from about 40 mm to about 50 mm, or within other ranges. In the expanded configuration, the width W2' of the neck portion 20 can vary from about 30 mm to about 70 mm, from about 30 mm to about 40 mm, from about 35 mm to about 45 mm, from about 40 mm to about 60 mm, from about 40 mm to about 70 mm, or within other ranges. However, one skilled in the art will understand that the bulb and neck portions 10, 20 can have other dimensions such that they conveniently fit within a user's (e.g., child's) mouth.

The bulb portion 10 can be coupled to the neck portion 20 in any suitable manner. In some embodiments, the bulb and neck portions 10, 20 can be integrally or monolithically formed from the same material. Walls of the bulb and neck portions 10, 20 can have any suitable thickness, which can be the same along a surface of the portions or it can vary. For example, in aspects in which the neck portion 20 has one or more expansion accommodation portions, such portions can be thinner than the rest of the neck portion 20. In some embodiments, the bulb and neck portions 10, 20 can be formed from different materials having different thickness. The bulb and neck portions 10, 20 can be formed from any suitable elastomeric material or combinations of the materials, such as a natural or synthetic rubber, silicone, or any other material(s).

In some aspects, the bulb and neck portions 10, 20 can be formed separately such that they can be coupled to one another by, for example, gluing, molding, ultrasonic welding or using other any technique. In some embodiments, the bulb and neck portions 10, 20 can be removably coupled to one other (or via a threaded connection, snap-fit, etc.).

In the example illustrated, both the bulb and neck portions 10, 20 can be hollow. However, in some aspects, the bulb portion 10 can be hollow while the neck portion 20 can include one or more elements or mechanisms configured to facilitate operation of the oral device 200. Furthermore, one or more portions of the neck portion 20 can be formed such that they include material forming the neck portion 20 or any other material(s), to ensure desired degrees of expansion and contraction of the neck portion 20 during use of the device 200.

The support or base portion 30 can have any suitable configuration, size, and shape. In the example of FIGS. 3A and 3B, the support portion 30 can have a generally oval shape to facilitate the shape changes of bulb and neck portions 10, 20 during sucking and feeding. The base portion 30 can be flexible and extendable such that the entirety or at least a portion thereof can expand and contract to accommodate expansion and contraction of the neck portion 20 during use of the oral device 200.

The base portion 30 can be formed integrally or monolithically with the neck portion 20 or it can be a separate component coupled to the neck portion 20. The base portion 30 can be coupled to the neck portion 20 in any suitable manner, for example, molded, glued, snapped, threaded, or otherwise attached to the neck portion 20. In some embodiments, the base portion 30 can be inserted into the neck portion 20. Furthermore, in some embodiments, the neck portion 20 and the base portion 30 can be removably coupled to each other (e.g., for cleaning).

As shown in FIG. 3A, in the illustrated example, the neck portion 20 is directly coupled to the base portion 30. The base portion 30 can be wider or narrower than the neck portion 20 in one, two and/or three dimensions. As mentioned above, the base portion 30 can be configured to be flexible to accommodate the shape changes of neck portion 20 during the sucking. It should be appreciated that base portion 30 in FIG. 3A is shown for illustration purposes only, as the described embodiments are not limited to any specific configuration of the base portion or other similar component(s) coupling the neck portion to a handle portion 40.

Figure 4C:
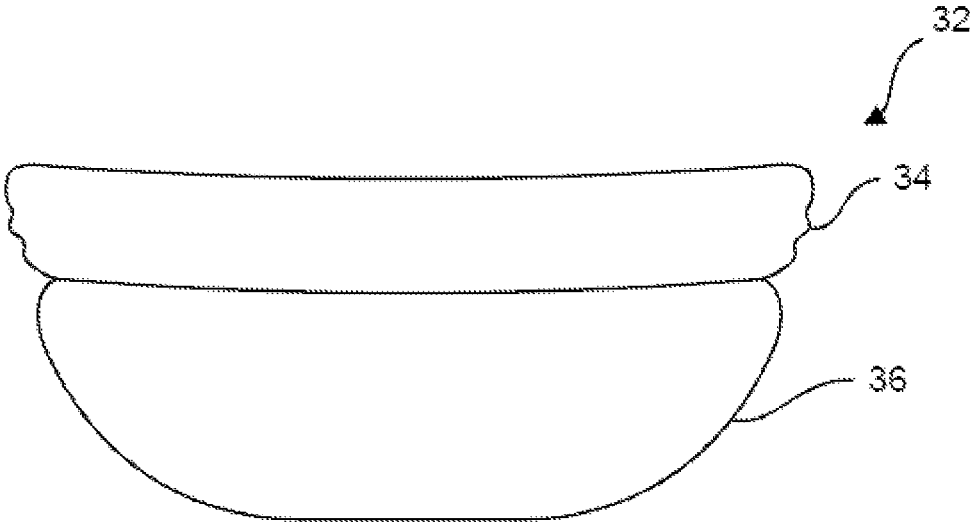
FIG. 4C is a schematic side view of an example of an adapter of an oral device.

In some aspects, the support portion can be in the form of an adapter configured to fit over a top of a bottle or other container. In such aspects, the support portion can be configured to as to both accommodate an expansion of a neck or body portion and to fit over a top of bottles of one or more sizes. For example, the support portion can be formed from a stretchable and resiliently flexible material. For example, FIG. 4C illustrates schematically an exemplary adapter 32 having a top portion 34 configured to couple with a neck of a suitable configuration (not shown) and a bottom portion 36 configured to fit over a bottle top. The top portion 34 can have a changeable configuration and can include more than one portions or features that can allow the adapter 32 to at least partially expand and contract as the neck portion integrally formed therewith or coupled thereto expands and contracts. The bottom portion 36 can retain its configuration during use of a respective device and it can be configured to expand or otherwise change it is configured to fit over a bottle top. Additionally, the bottom portion 36 can have a mechanism that allows it to be reversibly attached to a bottle. It should be appreciated that the adapter can be in the form of one portion that both accommodates expansion/contraction and allows the adapter to be disposed over a bottle top.

Referring back to FIG. 3A, the handle portion 40 coupled to the bulb and neck portions 10, 20 via the base portion 30 can also have any suitable configuration, size, and shape. The handle portion 40 is configured to be held by a user or any other person. Additionally or alternatively, the handle portion 40 can be configured to be attached to a hand of the user or to be otherwise associated with the user or user's clothing, blanket, etc. The handle portion 40 can have any suitable shape and a semicircular handle 40 is shown by way of example only. For example, the handle 40 can be shaped as an animal, flower, or it can have any other shape. Moreover, it should be appreciated that, in some aspects, the handle portion 40 can be omitted.

It should be appreciated that the oral device 200 can include any other component(s) not shown herein for the sake of simplicity. In aspects in which the oral device 200 is configured as a bottle cap, the bulb and neck portions 10, 20 are configured to receive liquid or food so that they deliver the liquid or food to the user's mouth.

In some embodiments, the oral device 200 can be configured as a teething tool and/or a toy. The teething tool can have a handle configured to be held by a user. The handle can be rounded, spherical, or it can have other shape such that it can be conveniently held by the user. The handle of the teething tool can include multiple neck portions or a single neck portion. One or more of the neck portions, in some embodiments, can have increased resilience as compared to a nipple portion of a pacifier. In some embodiments, the neck portion of a teething tool can have an extended shape. Furthermore, the handle can be omitted such that the neck portion can be in the form of an arch developer. Also, the neck portion can be integrated into a toy as a part of handling portion which babies often put into their mouth.

Regardless of the specific implementation of the oral device 200 and the age of the user, as the user is sucking on the device, the device allows proper breathing while using the device or while eating and drinking, by restoring the proper neuromuscular innervations for the normal function of the user's oral cavity.

As a child initially engages the neck of the oral device with her or his mouth, the natural tendency is to bring the corners of lips together mesially forward, which activates anterior tongue muscles forward, as well as upward in cases, and deactivates the cheek muscles passively pulling them inward. These inward, forward, and upward movements of oral-facial muscles, in turn, exert the constrictive forces on the dental arch, and thus to a palate. As the child begins to suck on a conventional oral device, the constrictive force is continuously generated. At the same time, such constrictive neuromuscular innervations during sucking disrupt the innervations of the glossal-palatal-pharyngeal muscles. Sucking is a part of the normal oral physiology involving the digestive and respiratory, as well as the auditory systems. The normal sucking (e.g., during breastfeeding) induces closure of fauces and opening of choana to modulate breathing, swallowing, as well as the opening of the middle ear tube. Sealing the oral chamber, food and liquid can be held in mouth, thus, a child can breathe while sucking and chewing, without aspiration and frequent swallowing and with proper opening of the middle ear. The oral devices in accordance with the described techniques are configured to cause the normal anatomy and function of the oral structures by the child to mimic the physiologic movements of the child's mouth during breastfeeding.

In some embodiments, as mentioned above, an oral device in accordance with the described techniques can include an expansion accommodation portion adapted to accommodate a lateral expansion of a neck and/or an expansion of a bulb portion towards the user's throat when the oral device is in use. The expansion accommodation portion can also be configured, when the oral device is not in use, to retract as the neck portion recovers its shape and/or moves downward away from the palate area (towards user's lips), suppressing the anterior tongue muscle. The expansion accommodation portion can have any suitable configuration and it can allow walls of at least one of the neck and bulb portions to expand laterally, as the neck portion flattens.

When an oral device in accordance with the described techniques is sucked on by the user, the bulb portion and at least a portion of a neck portion are positioned inside the user's mouth. Sucking movements performed by the user can change an original configuration of the oral device. In some aspects, the oral device can be configured such that its neck portion is not symmetrical along a longitudinal axis of the device.

Figure 5A:
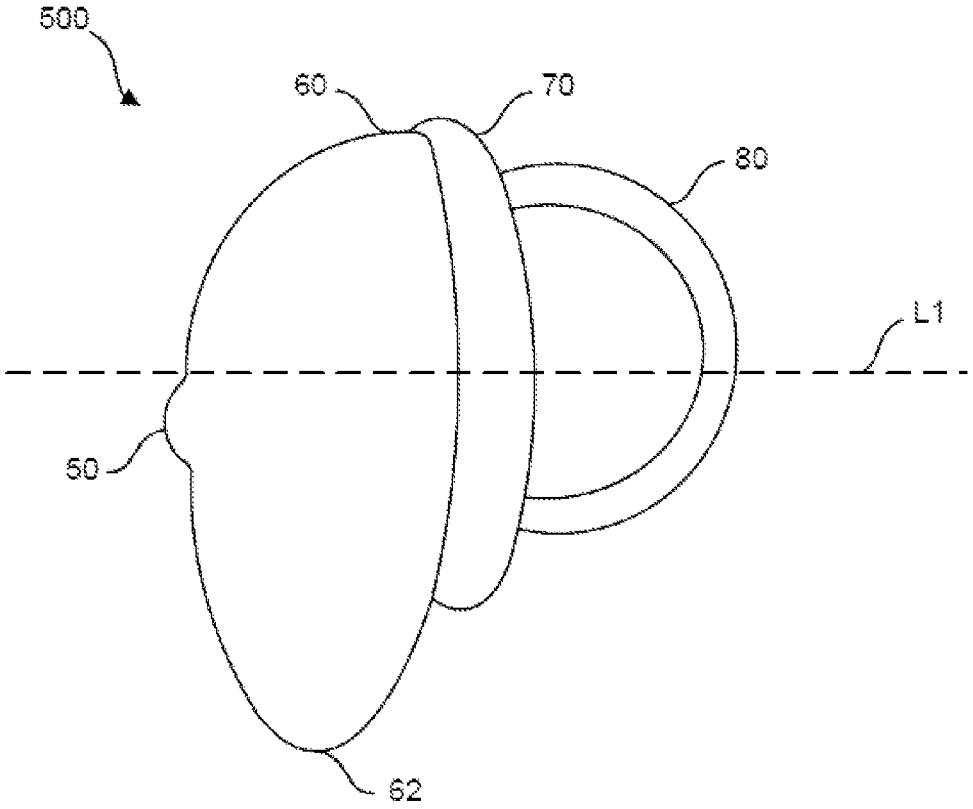
FIG. 5A is a schematic side view of one example of an oral device in an original configuration.
Figure 5C:
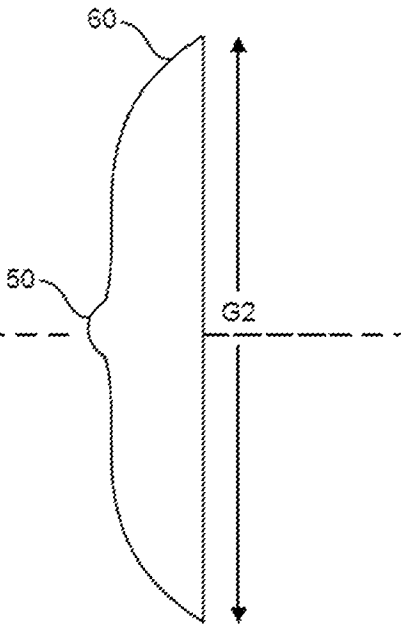
FIG. 5C is a schematic side view of the neck portion of FIG. 5B in an expanded configuration.
Figure 5B:
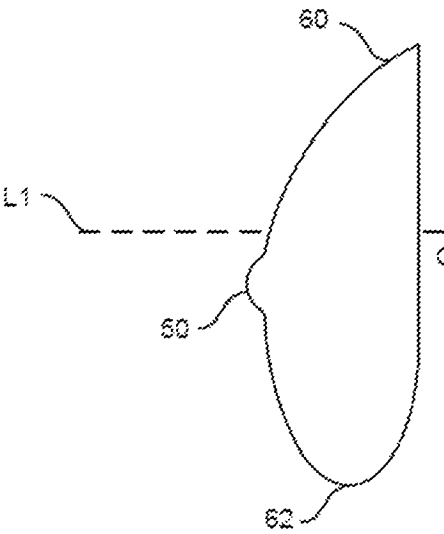
FIG. 5B is a schematic side view of a neck portion of the oral device of FIG. 5A in an original configuration.

FIGS. 5A, 5B, and 5C illustrate an example of an oral device 500 having a bulb portion 50, a neck portion 60, a base portion 70, and a handle 80. The bulb portion 50, shown as having a semi-circular shape, can be small as compared to the neck portion 60. In the example illustrated, similar to bulb and neck portions 10, 20 of FIG. 3A, the bulb portion 50 resembles a nipple of a female breast and the neck portion 60 resembles the breast. The base and handle portions 70, 80 can be similar to base and handle portions 30, 40 of oral device 200 (FIGS. 3A and 3B).

The neck portion or neck 60 is shaped so that at least a portion thereof or substantially the entirety thereof conveniently fits within a mouth of a child. As shown in FIGS. 5A and 5B, in the original configuration of the oral device 500, the bulb and neck portions 50, 60 are disposed asymmetrically with respect to a longitudinal axis L1 of the device 500. In this example, as also shown in FIGS. 5A and 5B, the neck 60 can have an extended portion 62 that can in the form of a loose, baggy section of the neck 60. Thus, when the oral device 500 is positioned as shown in FIG. 5A, the extended portion 62 extends downward due to gravity. The extended portion 62 causes the bulb and neck portions 50, 60 to be disposed asymmetrically with respect to the longitudinal axis L1 in the original configuration of the oral device 500.

The extended portion 62 can be one or more portions disposed on one side with respect to the longitudinal axis L1 of the device 500. The extended portion 62 can also be formed within the neck portion 60 such that it is disposed substantially around a circumference of the neck 60.

The extended portion 62 can have walls having a uniform thickness. Alternatively, the thickness of the wall and/or other properties can vary. For example, wall areas close to an outer contour of the portion 62 can be thicker than the areas close to the middle of the portion 62. However, other variations of the wall thickness of the extended portion 62 can be used additionally or alternatively.

The extended portion 62 can be formed in a number of different ways. For example, the extended portion 62 can be formed by thinning, stretching or otherwise modifying a material used to form the portion 60. Such material can be modified in a uniform manner or so as to form multiple sub-portions within the neck 60 together forming the extended portion 62. As another example, the extended portion 62 can be formed by using a material that is different from one or more materials used to form the rest of the neck portion 60.

The extended portion 62 of the neck portion 60 can facilitate expansion of the neck portion during use of the device 500. Thus, the extended portion 62 can operate as an expansion accommodation portion. As shown in FIGS. 5B and 5C illustrating the bulb and neck 50, 60 of the oral device 500, when the neck 60 is sucked on by the user, the neck 60 flattens and reversibly moves from a first, unexpanded configuration shown in FIG. 5B to a second, expanded, configuration shown in FIG. 5C. In use, the bulb 50 and at least a portion of the neck 60 (e.g., substantially the entirety of the neck 60) are disposed within the user's mouth such that the neck 60 is sucked on, the neck 60 can flatten. In this way, the neck 60 is at least partially expanded inwardly such that a shape of the neck portion 60, as shown in FIG. 5C. As also shown in FIGS. 5B and 5C, when the neck portion 60 is sucked on and thus reversibly moves to the expanded configuration, the length (or height) of the neck 60 increases from an original length G1 to a larger length G2. The length of the neck 60 decreases when it partially or entirely retracts. The oral device 500 is configured such that, when the user stops sucking on the device, the neck 60 can be pulled away from the user's mouth, thus preventing continuation of abnormal sucking.

As a child sucks on the oral device described therein, the oral device causes the outward motion of the cheek muscles which pulls corners of the child's mouth back, thus, changes the configuration of the lip posture laterally. As a result, the use of the oral device weakens the constrictive sucking forces and engages the normal sucking forces, which, in turn, activates the glossal-palatal-pharyngeal muscles. Furthermore, as the oral device is being used, it causes the user's tongue to retract posteriorly and moves the posterior segment of the tongue laterally and superiorly. In this way, the lateral forces applied to the palate and dental arches are generated and the oropharyngeal isthmus closes. As a result, the risk of deformation of the dental arch, malocclusions or other dental problems is decreased or eliminated, and the risk of dysfunctional-physiologic transmission between respiratory and digestive system is greatly reduced, particularly during infant feeding in the supine position.

Figure 6A:
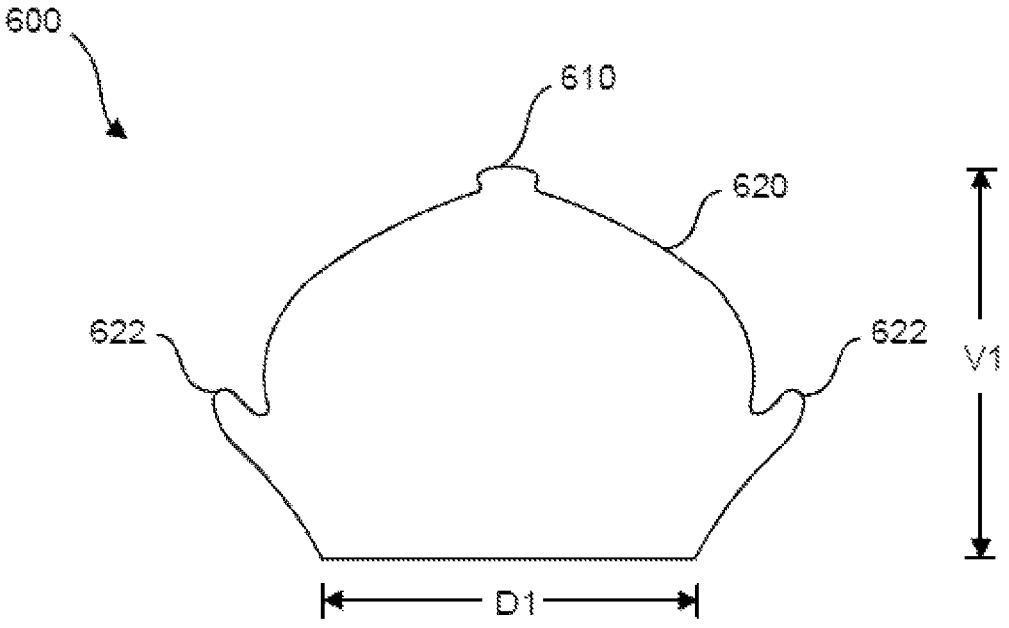
FIG. 6A is a schematic side view of an example of a neck portion of an oral device having at least one expansion accommodation portion, showing the neck portion in an original configuration.
Figure 6B:
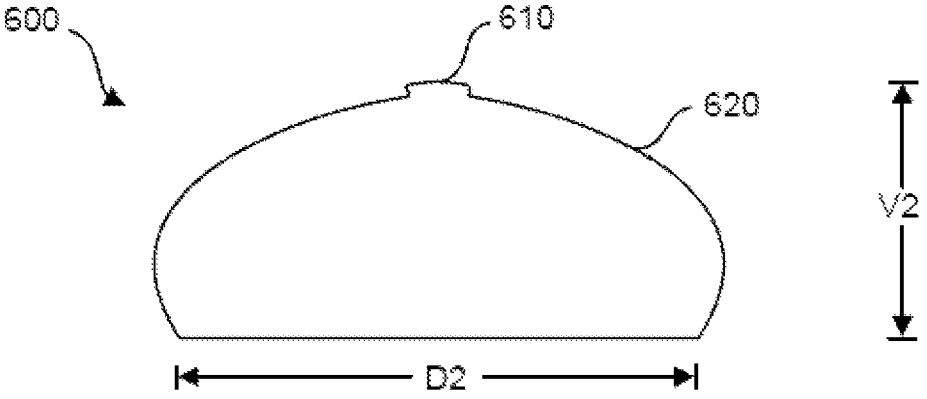
FIG. 6B is a schematic side view of the neck portion of FIG. 6A in an expanded configuration.

FIGS. 6A and 6B illustrate an example of an oral device 600 including a bulb portion 610 and a neck portion 620. The oral device 600 can be similar to oral device 200 (FIG.

3A) or oral device 500 (FIG. 5A). As shown in FIGS. 6A and 6B, the neck portion 620 may, for example, include an expansion accommodation portion 622 that is configured to accommodate the lateral expansion of the neck portion 620 by compression and/or the expansion in a direction towards the user's mouth when the bulb portion 610 and at least a portion of the neck portion 620 are inside the user's mouth and the neck portion 620 is being sucked on by the user.

The expansion accommodation portion 622 can have any suitable shape to allow the neck portion 620 and the bulb portion 610 to expand and contract as the user is sucking the oral device 600. In the example illustrated, as shown in FIG. 6A, in a first (original), unexpanded configuration of the oral device 600, the expansion accommodation portion 622 can be shaped as folds, creases, indentations, or ridges of the neck portion 620 formed on opposite sides of the neck portion 620. It should be appreciated that, although the expansion accommodation portion 622 is shown in FIG. 6A as one fold formed on each side of the neck portion 620, more than one folds or other features can be formed on each side, including folds having different sizes, shapes, degrees of fold, etc. Furthermore, the expansion accommodation portion can be formed such that it is disposed along the entire or substantially entire circumference of the neck portion 620.

The expansion accommodation portion 622 can be disposed at any location along the length of the neck portion 620. Furthermore, the expansion accommodation portion 622 can be formed radially around the entire neck portion 620 or around a part of the neck portion. As another variation, the expansion accommodation portion 622 can be in a form one or more suitable patterns formed in the neck portion.

The folds, creases, indentations, ridges, or other structures defining the expansion accommodation portion 622 can be formed by folding or otherwise modifying a portion of a wall of the neck portion 620. These structures can be formed integrally or monolithically with the wall of the neck portion 620 or they can be formed as suitable surface features that facilitate expansion of the neck portion 620 as a user performs a sucking action. In the example of FIGS. 6A and 6B, the expansion accommodation portion 622 can be formed by folding a portion of the neck portion 620 inwardly and distally, in the direction towards inside of the user's mouth. However, one or more folds or other structures can be formed in any other manner to allow expansion of the neck portion. Also, the expansion accommodation portion 622 can be formed as a radial fold or other structure(s) around a circumference of the neck portion 620. The expansion accommodation portion 622 can have an accordion configuration or other configurations.

As shown in FIG. 6A, the bulb portion 610 and the neck portion 620 can be configured to have a trapezoidal or approximately trapezoidal shape in the original configuration. However, it should be appreciated that the neck and bulb portions can have other suitable shapes.

As shown in FIGS. 6A and 6B, during the sucking action, the expansion accommodation portion 622 allows a width of the neck portion 620 to reversibly increase by compression from a width D1 (FIG. 6A) to a greater width D2 (FIG. 6B). As also shown, when the neck portion 620 moves to the expanded configuration, the height or longitudinal length of the neck portion 620 can reversibly decrease from a height V1 to a height V2. At the same time, at least a part of the bulb portion 610 can expand towards the user's throat. As illustrated in FIG. 6B, when the neck portion 620 expands during the sucking action, the expansion accommodation portion 622 expands so that its structural features (e.g., folds shown in FIG. 6A) change their configuration (e.g., they are no longer visible as separate features, as in FIG. 6B), since the features are "unfolded" or otherwise modified in the expanded configuration.

The neck portion 620 is configured such that, when the sucking motion stops, the structural features of the expansion accommodation portion 622 return to their configuration, such as the configuration shown or a similar configuration in FIG. 6A. For example, when the device 600 remains within the user's mouth during its use, the expansion accommodation portion 622 can partially return to its configuration shown in FIG. 6A. When the sucking stops (e.g., a child falls asleep or stops eating), the expansion accommodation portion 622 can return to its original configuration as shown in FIG. 6A, thus facilitating retraction of the neck portion 620. A person skilled in the art will appreciate that the expansion accommodation portion 622 can be configured to change its configuration in any suitable manner to accommodate for expansion and retraction of the neck portion 620.

Additionally or alternatively, in some embodiments, the expansion accommodation portion can have different characteristics than the bulb portion and/or an area of the neck portion not occupied by the expansion accommodation portion. For example, the expansion accommodation portion can have greater elasticity and it can thus be more stretchable than the other areas of the neck portion. In some aspects, the expansion accommodation portion can be formed from the same material as the rest of the neck portion. In some aspects, the expansion accommodation portion 622 can be formed from a material different from one or more materials used to form the rest of the neck portion, or from a combination of materials having varying thickness and/or consistency.

In some aspects, the expansion accommodation portion 622 is thinner than the portion of the neck portion 620 not occupied by the expansion accommodation portion 622 and/or the bulb portion 610. The material in a portion of the neck portion 620 forming the expansion accommodation portion 622 can be made thinner than the remainder of the neck portion 620 using any suitable techniques as known in the art.

As another example, the expansion accommodation portion can be made from a softer material which is softer than the bulb portion and/or the other portion(s) of the neck portion. The softer expansion accommodation portion can more gently accommodate the lateral expansion of the neck. The expansion accommodation portion can span an area of the neck portion or it can form various patterns on a surface of the neck portion. The patterns can be created by one or more features formed on the neck portion and/or different properties of material(s).

The width of the neck portion increases in the lateral direction thereof as it flattens to increase the lateral contact area of neck portion with the user's lips. In this way, the abnormal force applied to the user's dental arch and palate, as well as insufficient closure of fauces, when the oral device is sucked by the user, decreases, thereby preventing the user's dental arch and palate from being abnormally developed, as well as preventing the dysfunctional-physiological transmission between the respiratory and digestive systems.

It should be appreciated that, in some aspects (e.g., as shown in FIGS. 3A and 3B), a portion of a neck portion of an oral device or substantially entire neck portion can operate as an expansion accommodation portion, such as no specific features are formed to define the expansion accommodation portion. Furthermore, in some aspects, a neck portion of an oral device can additionally or alternatively include a retraction accommodation portion configured to facilitate retraction of one or more components of the oral device.

Having thus described some examples of the described aspects, various alterations, modifications, and improvements will readily occur to those skilled in the art. Such alterations, modifications, and improvements are intended to be within the spirit and scope of the described aspects. Accordingly, the foregoing description is by way of example only, and not intended to be limiting.

All references that are recited in this application are incorporated in their entirety herein by reference.

What is claimed is:

1. An oral device comprising:

a bulb portion configured to be disposed inside a mouth of a user;

a neck portion coupled distally to the bulb portion and configured to be held by user's lips and having at least one expansion accommodation portion, the expansion accommodation portion including a material that is softer than a material forming at least one of an other portion of the neck portion and the bulb portion; and a base portion coupled distally to the neck portion;

wherein, when the neck portion is sucked by the user, the neck portion moves in a lateral direction transverse to a longitudinal axis of the oral device from a first, unexpanded configuration to a second, expanded configuration such that a lateral contact area of the neck portion with user's lips increases, and wherein the base portion is configured to facilitate changes in configuration of the neck portion as the neck portion moves between the first and second configurations, and the at least one expansion accommodation portion is configured to allow lateral expansion of the neck portion.

2. The oral device of claim 1, wherein a width of the neck portion is greater than a width of the bulb portion along entire lengths of the bulb and neck portions and widest where lips rest.

3. The oral device of claim 1, wherein the neck portion comprises an expansion accommodation portion adapted to accommodate the lateral expansion of the neck portion.

4. The oral device of claim 1, wherein the neck portion is configured to move to the second, expanded configuration as a result of translation and compression forces exerted by the upper and lower lips pressure onto a top and a bottom of the neck portion.

5. The oral device of claim 1, wherein, when the oral device is in the first configuration, the at least one expansion accommodation portion is configured to cause the neck portion to be disposed asymmetrically with respect to a longitudinal axis of the oral device.

6. The oral device of claim 1, wherein the expansion accommodation portion is thinner than at least one other portion of the neck and the bulb portions.

7. The oral device of claim 1, wherein the expansion accommodation portion comprises at least one first material, and at least one of the bulb portion and an other portion of the neck portion comprises at least one second material that is different from the at least one first material.

8. The oral device of claim 1, wherein the expansion accommodation portion includes at least one feature configured to change its configuration when the neck portion moves from the first configuration to the second configuration.

9. The oral device of claim 8, wherein the at least one feature comprises at least one fold, crease, indentation, or ridge.

10. The oral device of claim 1, wherein at least one of the bulb portion and the neck portion has a generally trapezoidal shape in the first configuration.

11. The oral device of claim 1, wherein at least one of the bulb portion and the neck portion has a dome-like shape.

12. The oral device of claim 1, wherein at least one of the bulb portion and the neck portion has a generally rectangular or generally square shape.

13. The oral device of claim 1, further comprising a base portion coupled to a distal end of the neck portion, wherein the neck portion is directly coupled to the base portion.

14. The oral device of claim 1, wherein the oral device comprises a pacifier.

15. The oral device of claim 1, wherein the oral device comprises a bottle cap.

16. The oral device of claim 1, wherein the oral device comprises a teething tool or toy.

17. The oral device of claim 1, wherein the bulb and neck portions mimic a shape of a female nipple and breast.

18. The oral device of claim 1, wherein the neck portion comprises a retraction accommodation portion adapted to accommodate retraction of the neck portion away from user's oral cavity.

19. A method of preventing or treating deformation of an arch form and malocclusion of teeth of a user, the method comprising:

administering an oral device to the user, the oral device comprising a bulb portion and a neck portion coupled distally to the bulb portion, so that the bulb portion is disposed inside a mouth of the user and the neck portion is held by user's lips, the neck portion having an expansion accommodation portion including a material that is softer than a material forming at least one of an other portion of the neck portion and the bulb portion;

wherein, when the neck portion is sucked by the user, the neck portion moves in a lateral direction transverse to a longitudinal axis of the oral device from a first, unexpanded configuration to a second, expanded configuration such that a lateral contact area of the neck portion with the user's lips increases, the expansion accommodation portion accommodating the lateral expansion of the neck portion.

20. The method of claim 19, wherein the neck portion moves to the expanded configuration such that a width of the neck portion increases.

21. The method of claim 19, wherein a width of the neck portion is greater than a width of the bulb portion along entire lengths of the bulb and neck portions.

* * * * *